United States Patent [19]

Gretz

[11] Patent Number: 4,494,940

[45] Date of Patent: Jan. 22, 1985

[54] MODEL AIRCRAFT

[75] Inventor: Charles Gretz, Suisun, Calif.

[73] Assignee: Life-Like Products, Inc., Baltimore, Md.

[21] Appl. No.: 369,567

[22] Filed: Apr. 19, 1982

[51] Int. Cl.[3] ..... A63H 27/00

[52] U.S. Cl. ..... 446/61; 446/93

[58] Field of Search ..... 46/79, 80, 81, 76 R

[56] References Cited

U.S. PATENT DOCUMENTS 2,059,131 10/1936 McGall ..... 46/80

FOREIGN PATENT DOCUMENTS 315645 3/1934 Italy ..... 46/81

*Primary Examiner*—M. Yu

*Attorney, Agent, or Firm*—Shapiro and Shapiro

[57] ABSTRACT

A model aircraft, such as a glider, includes a clip for connecting separable wing members thereof to the fuselage. The clip has a resilient bridge portion and spaced depending limbs. The clip fits over an arch section of the fuselage with the limbs having a friction fit in openings in the wings, whereby the wings and fuselage are secured together. The wings may fit in a wing slot in the fuselage with inboard sections of the wings having recesses locating against tabs within the slot. The arch section of the fuselage may be recessed so that the clip when assembled is flush with adjacent surfaces of the fuselage, whereby the appearance and aerodynamic characteristics of the aircraft are unimpaired. The clip connection may allow for vertical hinging of the wings upon impact to absorb impact forces and prevent wing separation.

10 Claims, 8 Drawing Figures

MODEL AIRCRAFT

BACKGROUND OF THE INVENTION

This invention relates to model aircraft, particularly gliders, which have a fuselage and separate wings.

In some model gliders, see for example co-pending U.S. patent application Ser. No. 163,426, filed June 27, 1980, and commonly assigned herewith, the fuselage and wings are integrally formed. In other designs, however, e.g., gliders having a significant wing span, it may be expedient to manufacture and package the fuselage and wings separately and to assemble the glider in situ. This allows for more compact and secure packaging and transportation.

With the latter type of structure, it is necessary to provide a suitable connection for assembling the fuselage and wings. Such connection should have sufficient strength to withstand forces developed during launching and flight. It may also be beneficial for the connection to be designed to absorb impact forces, at least to a degree, so that on landing, for example, the impact forces involved may not cause separation of the wings from the fuselage. Clearly, the connection should also allow for simple assembly and disassembly of the aircraft.

SUMMARY OF THE INVENTION

The present invention provides a clip-type connection between a fuselage and separable wings of a model aircraft, which is simple to assemble, which has adequate strength in flight, and which does not detract from the overall appearance and aerodynamic characteristics of the aircraft.

In accordance with the invention, at least in one aspect thereof, model aircraft apparatus comprises an aircraft fuselage, wings, and a generally U-shaped clip for attaching the wings to the fuselage in a flying position, the wings having openings disposed on opposite sides of the fuselage respectively when the wings are in said position and the clip including a bridge portion and opposed depending limbs, the bridge portion being adapted to fit over the fuselage, with the limbs on opposite sides of the fuselage and with the limbs fitting in said openings in the wings, thereby securing the wings to the fuselage.

In one form of the invention, for example, the wings may comprise separate port and starboard wing members having inboard sections formed with the above-noted openings, the inboard sections fitting in a wing slot in the fuselage. The fuselage may, for example, have an arch portion which leads into the slot and which receives the clip. Preferably, so as not to detract from the overall appearance and aerodynamic characteristics of the aircraft, the arch portion may be recessed so that when the clip is received therein, the outer surfaces of the clip and adjacent portions of the fuselage are substantially flush.

The bridge portion of the clip may be resilient, and the limbs may be adapted to fit in the openings of the wings with a friction fit. The design of the clip and openings in the wings may be such as to allow slight movement of the wings so that impact forces may be absorbed without separation of the wings from the fuselage.

Additional features of the invention will become apparent from the ensuing description and claims, in conjunction with the accompanying drawings.

DESCRIPTION OF PREFERRED EMBODIMENT

Figure 1:
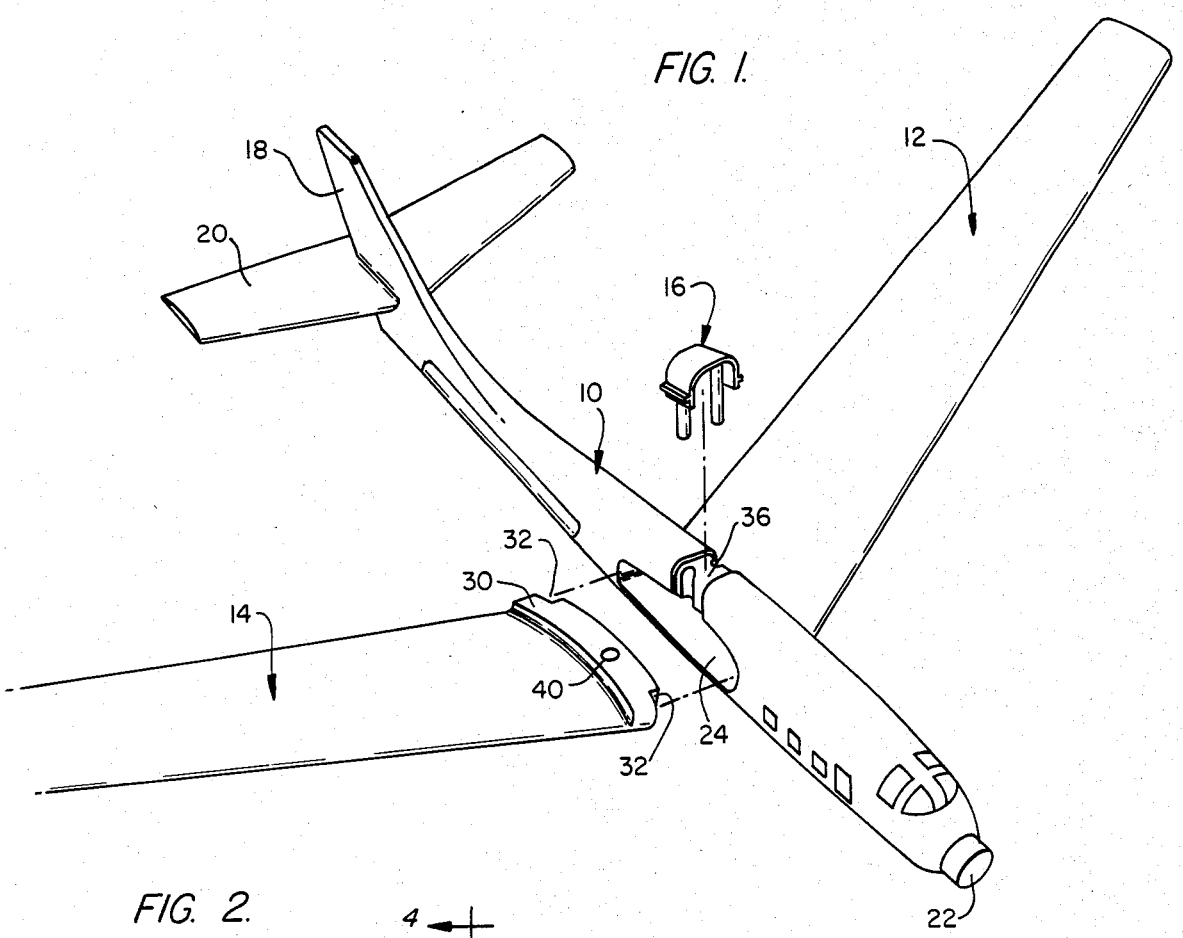
FIG. 1 is an exploded perspective view of a model glider in accordance with the invention.
Figure 2:
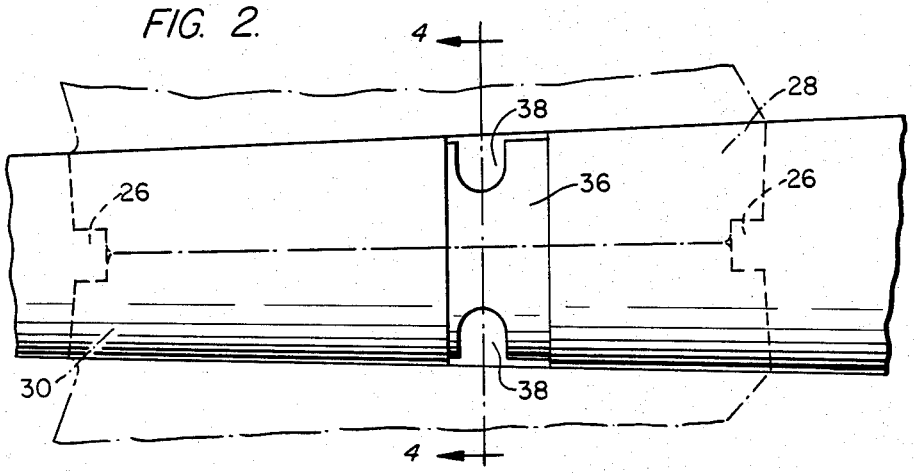
FIG. 2 is a plan view of a part of the fuselage of the glider with inboard parts of the wings shown in phantom.

Referring initially to FIG. 1, there is shown a model glider comprising a fuselage 10, separate port and starboard wing members 12 and 14, defining the aircraft wings, and a clip 16 for connecting the fuselage and wing members together. The fuselage may be formed integrally with a tail plane 18 and stabilizer 20, or the stabilizer may be slotted into or otherwise connected to the fuselage. The fuselage and wings may be made in a relatively rigid molded foam plastic material, such as styrofoam, and the nose of the fuselage may be provided with a relatively soft impact-absorbing bumper 22, which may be of the type referred to in the aforementioned co-pending application.

Figure 3:
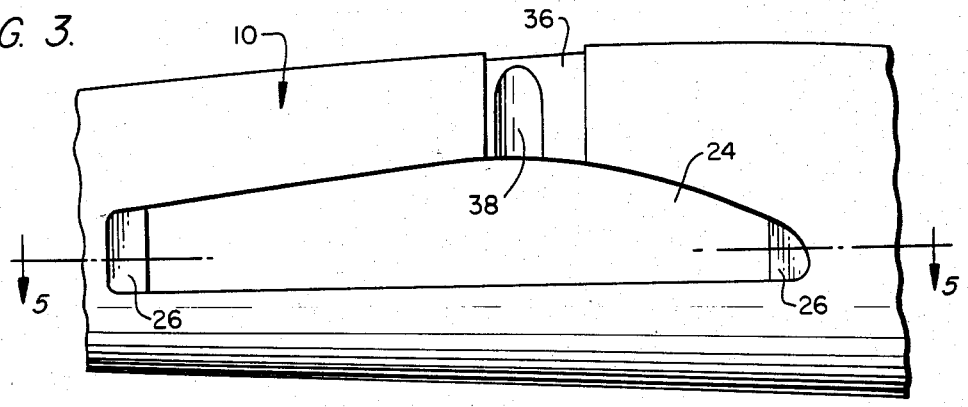
FIG. 3 is an elevational view of that part of the fuselage shown in FIG. 2.
Figure 4:
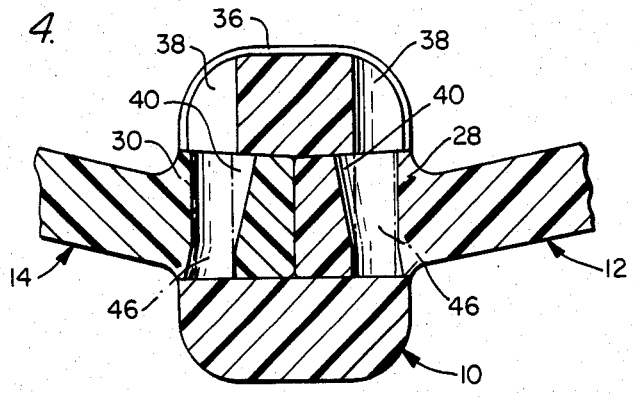
FIG. 4 is a cross-section on line 4—4 of FIG. 2.
Figure 5:
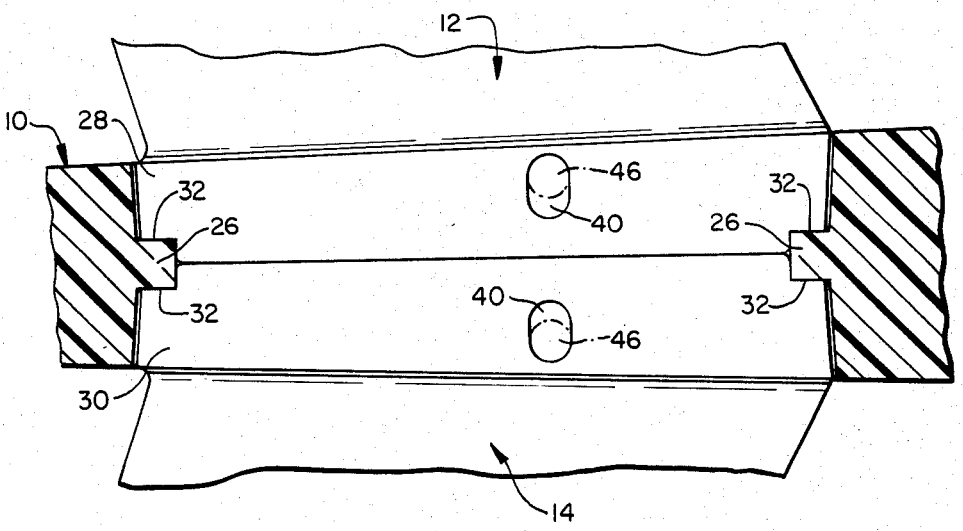
FIG. 5 is a view on line 5—5 of FIG. 3, but also showing the inboard parts of the wings in position.

The fuselage has a wing slot 24, which may extend completely through the fuselage and which may be provided front and rear with wing-locating tabs 26 (see FIGS. 3 and 5). Wing members 12 and 14 have thickened flange sections 28, 30 at their inboard ends with front and rear recesses 32 (see FIGS. 4 and 5). The flange sections fit into apertures provided by the open opposite ends of wing slot 24, with recesses 32 registering with tabs 26 so as to properly locate each wing member laterally and longitudinally, whereby the wings are received in the slot in flying position. A recessed arch section 36 at an upper portion of the fuselage leads into the wing slot, for receiving clip 16 as will be described. The arch section has a vertically extending groove 38 on each side, the grooves aligning with respective openings 40 in the flange sections of the wings.

Figure 6:
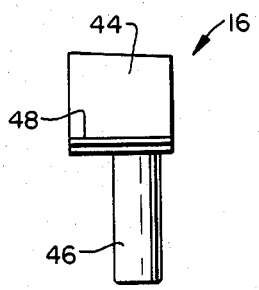
FIG. 6 is a side elevational view of a clip used in assembling the glider.
Figure 7:
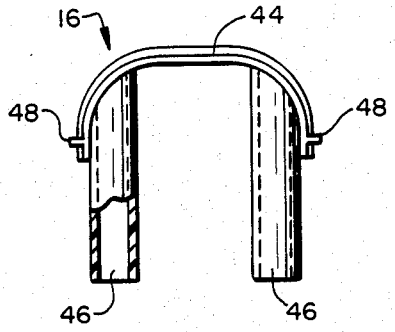
FIG. 7 is a front elevational view of the clip.
Figure 8:
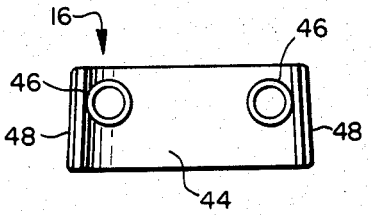
FIG. 8 is an underneath plan view of the clip.

Clip 16 (FIGS. 6–8) which may, for example, be molded in a plastic such as high impact styrene or the like, preferably is of a generally U-shaped form having a relatively thin resilient bridge portion 44 and depending hollow circular section limbs 46. In use, with the wing members properly positioned in the wing slot, bridge portion 44 of the clip is placed over arch section 36 of the fuselage, with the limbs 46 locating in grooves 38. The clip can then be pressed down so that the bridge portion 44 fits into and rests upon arch section 36 and so that the limbs 46 are received in the openings 40 in the respective wing sections. The spacing between limbs 46 and openings 40 and the cross-sectional dimensions of the limbs and openings may be such that when the clip is pressed fully home (see FIG. 4) the limbs have a friction fit in openings 40 sufficient to hold the wings and fuselage in an assembled condition. As shown in FIG. 4, the limbs 46 have free ends that terminate within the fuselage. The bridge portion 44 of the clip has a degree of resiliency to accommodate any small discrepency in spacing between the limbs 46 and openings 40. Bridge portion 44 of the clip may be provided with lengthwise ribs 48 which aid in gripping the clip.

The thickness of bridge portion 44 of the clip may conform to the depth of arch section 36, so that when assembled, the clip is substantially flush with adjacent surfaces of the fuselage. Thus, the appearance and aerodynamic properties of the glider are substantially unimpaired by the presence of the clip. It will be seen from FIGS. 2 and 3, and FIGS. 6 and 8, that limbs 46, 48 are offset from the transverse centerline of the clip, as are the grooves 38 relative to the arch section 36 of the fuselage. This is to ensure that the clip can only fit in arch section 36 in the correct direction, so as to preserve the contours of the fuselage.

The resilience of bridge portion 44 of the clip, and lateral enlargement of portions of the openings 40 relative to limbs 46 (see FIGS. 4 and 5 where the limbs are shown in phantom) may allow a degree of vertical hinging of the wings when assembled. This provides the glider with an impact absorption characteristic, which may, for example, prevent separation of the wings from the fuselage due to landing impact.

It will be undersood that the glider may be disassembled simply by removal of the clip, and may be reassembled as previously described. Thus, the invention provides a simple means for assembling separate fuselage and wing members of a model aircraft, which can provide the strength required during launching and flight without detracting from the overall appearance or performance of the aircraft.

While only a preferred embodiment of the invention has been described herein in detail, the invention is not limited thereby, and modifications may be made within the scope of the attached claims.

What is claimed is:

1. Model aircraft apparatus comprising an aircraft fuselage, wings, and a generally U-shaped clip for attaching the wings to the fuselage in a flying position, the wings having openings disposed on opposite sides of the fuselage, respectively, when the wings are in said position, and the clip including a bridge portion and opposed depending limbs, the bridge portion being adapted to fit over the fuselage with the limbs on opposite sides of the fuselage, and with the limbs fitting in said openings in the wings, thereby securing the wings to the fuselage, the fuselage including a recessed arch section in which the bridge portion of the clip is adapted to fit with the outer surface of the clip substantially flush with adjacent surfaces of the fuselage, the arch section including grooves for receiving the respective limbs of the clip, and the limbs of the clip being offset from the transverse center line of the bridge portion and the grooves being offset from the transverse center line of the arch section, so that the clip can only be received in the arch section in one direction.

2. Model aircraft apparatus comprising an aircraft fuselage that is shaped to have substantial thickness, a pair of wings, and a generally U-shaped clip for attaching the wings to the fuselage in a flying position, the fuselage having apertures at opposite sides thereof below an upper portion of the fuselage, the wings having integral inboard ends that fit into and substantially fill the apertures, respectively, and that have openings disposed on opposite sides of the fuselage, respectively, when the wings are in said flying position, and the clip including a resilient bridge portion and opposed depending straight limbs extending from said bridge portion to free ends, the bridge portion being shaped to fit over and rest upon said upper portion of the fuselage with the limbs extending downwardly from said upper portion on opposite sides of the fuselage and fitting into said openings in the wings with a friction fit sufficient to retain the wings on the fuselage, but permitting the clip to be withdrawn for disassembly of the aircraft.

3. Apparatus as defined in claim 2, wherein the fuselage includes a recessed arch section at said upper portion in which the bridge portion of the clip fits with the outer surface of the clip substantially flush with adjacent surfaces of the fuselage.

4. Apparatus as defined in claim 3, wherein the arch section includes vertical grooves at opposite sides thereof for receiving the respective limbs of the clip.

5. Apparatus as defined in claim 2, wherein the wings comprise separate port and starboard wing members.

6. Apparatus as defined in claim 5, including complementary male and female wing-locating formations within said apertures and on the inboard ends of the wing members, respectively.

7. Apparatus as defined in claim 1, wherein the wings and fuselage comprise rigid molded foam plastic material.

8. Apparatus as defined in claim 7, wherein the clip comprises a high-impact molded plastic material.

9. Apparatus as defined in claim 1, wherein the openings in the wings are laterally enlarged relative to the limbs of the clip to allow vertical hinging of the wings for impact-absorbing purposes.

10. Apparatus as defined in claim 1, wherein the free ends of the limbs terminate within the fuselage.

* * * * *